US005863844A

United States Patent [19]

Girardot et al.

[11] Patent Number: 5,863,844

[45] Date of Patent: Jan. 26, 1999

[54] WASHING IMPLEMENT COMPRISING AN IMPROVED OPEN CELL MESH

[75] Inventors: Richard M. Girardot, Cincinnati; Gene M. Altonen, West Chester; Lyle B. Tuthill, Indian Hill, all of Ohio

[73] Assignee: The Procter & Gamble Company, Cincinnati, Ohio

[21] Appl. No.: 672,193

[22] Filed: Jun. 27, 1996

Related U.S. Application Data

[63] Continuation-in-part of Ser. No. 630,697, Apr. 12, 1996, abandoned.

[51] Int. Cl.[6] ..... B32B 5/02

[52] U.S. Cl. ..... 442/1; 442/41; 442/50

[58] Field of Search ..... 442/1, 41, 50; 428/131, 136

[56] References Cited

U.S. PATENT DOCUMENTS

| | | | |
|---|---|---|---|
| 1,533,868 | 4/1925 | Kingman | 15/229.1 |
| 1,659,977 | 2/1928 | Kingman | 15/208 |
| 1,689,207 | 10/1928 | Kingman | 15/229.1 |
| 1,794,854 | 3/1931 | Kean | 15/229.1 |
| 1,865,785 | 7/1932 | Parker | 15/209.1 |
| 1,963,529 | 6/1934 | Protz | 15/208 |
| 2,006,708 | 7/1935 | Benedict | 15/208 |
| 2,151,448 | 3/1939 | Steinberg | 2/158 |
| 2,601,771 | 7/1952 | Cameron | 66/170 |
| 2,857,610 | 10/1958 | Rympalski | 15/209 |
| 2,940,100 | 6/1960 | Grossmeyer | 15/118 |
| 3,169,264 | 2/1965 | Walker | 15/118 |
| 3,241,171 | 3/1966 | Benjamin et al. | 15/118 |
| 3,711,889 | 1/1973 | Jennings | 15/227 |
| 3,772,728 | 11/1973 | Johnson | 15/209 R |
| 3,778,172 | 12/1973 | Myren | 401/7 |
| 3,917,889 | 11/1975 | Gaffney et al. | 428/36 |
| 3,952,127 | 4/1976 | Orr | 428/255 |
| 3,957,565 | 5/1976 | Livingston et al. | 156/244 |
| 3,977,452 | 8/1976 | Wright | 150/3 |
| 4,017,949 | 4/1977 | Botvin | 28/77 |
| 4,020,208 | 4/1977 | Mercer et al. | 428/255 |
| 4,040,139 | 8/1977 | Botvin | 15/209 B |
| 4,052,238 | 10/1977 | Botvin | 156/148 |
| 4,057,449 | 11/1977 | Livingston et al. | 156/167 |
| 4,059,713 | 11/1977 | Mercer | 428/36 |
| 4,123,491 | 10/1978 | Larsen | 264/167 |
| 4,144,612 | 3/1979 | Yamaguchi | 15/208 |
| 4,152,479 | 5/1979 | Larsen | 428/224 |
| 4,154,542 | 5/1979 | Rasmason | 401/7 |
| 4,168,863 | 9/1979 | Hatcher | 300/21 |
| 4,196,490 | 4/1980 | Jonzon | 15/222 |
| 4,206,948 | 6/1980 | Shimizu | 300/21 |
| 4,287,633 | 9/1981 | Gropper | 15/209 B |
| 4,343,061 | 8/1982 | Hanazono | 15/244 B |
| 4,457,640 | 7/1984 | Anderson | 401/7 |
| 4,462,135 | 7/1984 | Sanford | 15/105 |
| 4,473,611 | 9/1984 | Haq | 428/198 |
| 4,651,505 | 3/1987 | Gropper | 53/456 |
| 4,710,185 | 12/1987 | Sneyd, Jr. et al. | 604/372 |
| 4,732,723 | 3/1988 | Madsen et al. | 264/147 |

(List continued on next page.)

FOREIGN PATENT DOCUMENTS

| | | |
|---|---|---|
| 60-264235 | 12/1985 | Japan . |
| 1308904 | 7/1973 | United Kingdom . |
| 1473147 | 9/1974 | United Kingdom . |
| 2237196 | 1/1991 | United Kingdom . |

*Primary Examiner*—Marion E. McCamish
*Assistant Examiner*—Elizabeth M. Cole
*Attorney, Agent, or Firm*—William Scott Andes

[57] ABSTRACT

An improved washing implement which exhibits superior softness, while also retaining good resiliency. To achieve the improved softness and resiliency of the improved washing implement an improved open cell mesh is provided which is softer and sufficiently resilient as a result of its controlled cell structure parameters. In preferred embodiments, the controlled physical parameters of the open cell mesh include basis weight, cell count, node count, node length and node diameter. Additionally there is provided a method of testing the mesh's resistance to an applied load, which provides an additional parameter for characterizing the mesh of the present invention.

20 Claims, 5 Drawing Sheets

U.S. PATENT DOCUMENTS

| | | | |
|---|---|---|---|
| 4,769,022 | 9/1988 | Chang et al. | 604/368 |
| 4,893,371 | 1/1990 | Hartmann | 15/209 B |
| 4,911,872 | 3/1990 | Hureau et al. | 264/146 |
| 4,948,585 | 8/1990 | Schlein | 424/40 |
| 4,969,226 | 11/1990 | Seville | 15/244.4 |
| 4,986,681 | 1/1991 | Oliver | 401/7 |
| 4,993,099 | 2/1991 | Emura et al. | 15/118 |
| 5,144,744 | 9/1992 | Campagnoli | 29/446 |
| 5,187,830 | 2/1993 | Giallourakis | 15/244.3 |
| 5,229,181 | 7/1993 | Daiber et al. | 428/58 |
| 5,295,280 | 3/1994 | Hudson et al. | 15/222 |
| 5,412,830 | 5/1995 | Girardot et al. | 15/118 |
| 5,465,452 | 11/1995 | Girardot et al. | 15/210.1 |
| 5,491,864 | 2/1996 | Tuthill et al. | 15/118 |

WASHING IMPLEMENT COMPRISING AN IMPROVED OPEN CELL MESH

This is a continuation-in-part of application Ser. No. 08/630,697, filed on Apr. 12, 1996, now abandoned.

TECHNICAL FIELD

This invention relates generally to an improved implement for bathing, scrubbing, and the like, i.e., a washing implement, which comprises an improved extruded open cell mesh. More particularly, this invention relates to an improved washing implement which exhibits superior softness while retaining acceptable resiliency. Optimization of the softness and resiliency of the washing implement is accomplished through control of a variety of physical features of the improved extruded open cell mesh.

BACKGROUND OF THE INVENTION

The production of extruded open cell mesh is known to the art. Plastic mesh has been used for a variety of purposes, such as mesh bags for fruits and vegetables. Open cell mesh provides a lightweight and strong material for containing relatively heavy objects, while providing the consumer with a relatively unobstructed view of the material contained within the mesh.

Open cell meshes have been adapted for use as implements for scrubbing, bathing or the like, due to the relative durability and inherent roughness or scrubbing characteristics of the mesh. Also, open cell meshes improve lather of soaps in general, and more particularly, the lather of liquid soap is improved significantly when used with an implement made from an open cell mesh. Mesh roughness is generally caused by the stiffness of the multiple filaments and nodes of the open cell mesh, and cause a scratching effect or sensation in many instances. To make a scrubbing or bathing implement, the extruded open cell mesh is shaped and bound into one of a variety of configurations, e.g. a ball, tube, pad or other shape which may be ergonomically friendly to the user of the washing implement. The open cell meshes of the past were acceptable for scrubbing due to the relative stiffness of the fibers and the relatively rough texture of the nodes which bond the fibers together. However, that same stiffniess and roughness of prior art mesh was relatively unacceptable to the general consumer when used as a personal skin care product.

There are a variety of methods for arranging multiple layers of extruded open cell mesh to formulate washing implements. For example, U.S. Pat. No. 5,144,744 to Campagnoli describes the manufacture of a bathing implement, in an essentially ball-like conformation, as does U.S. Pat. No. 3,343,196 to Baruhouse. Similarly, U.S. Pat. No. 4,462,135 to Sanford describes a cleaning and abrasive scrubber manufactured, in part, by the use of an open cell extruded plastic mesh. The Sanford implement is of a generally hourglass shape, although other cylindrical and tube-like structures are described. A rectangular scrubbing implement manufactured from extruded open cell mesh is described in U.S. Pat. No. 5,491,864 to Tuthill et al. However, these references do not describe or characterize a soft, yet resilient washing implement, as their open cell mesh was of the relatively rough nature described above.

Prior open cell mesh used to manufacture washing implements has typically been manufactured in tubes through the use of counter-rotating extrusion dies which produce diamond-shaped cells. The extruded tube of mesh is then typically stretched to form hexagonal-shaped cells. The description of a general hexagonal-shaped mesh can be found in U.S. Pat. No. 4,020,208 to Mercer, et al. An example of a counter-rotating die and an extrusion mechanism is described in U.S. Pat. No. 3,957,565 to Livingston, et al. Likewise, square or rectangular webbing has been formed in sheets by two flat reciprocating dies, as shown in U.S. Pat. No. 4,152,479 to Larsen. Although the aforementioned references describe open cell meshes and methods for producing open cell meshes, these references do not describe a soft, resilient product which can be used as a washing implement. Nor do any of the references listed above define a method of characterizing the softness and resilience of a mesh.

The references described above have been concerned primarily with the strength and durability of the open cell mesh for either containing relatively heavy objects, e.g., fruit and vegetables, or for vigorous scrubbing and cleaning, e.g., of pots and pans. In order to meet the strength and durability requirements, extruded open cell mesh of the past has been manufactured from relatively stiff fibers joined together at nodes whose physical size and shape tended to make them relatively stiff and scratchy, as opposed to soft and conformable.

Hence, heretofore, there has been a continuing need for an improved washing implement comprising an extruded open cell mesh which would be soft, durable, relatively inexpensive to manufacture, and relatively resilient without being overly stiff and scratchy. More specifically, there is a need for providing an improved open cell mesh, featuring physical characteristics which could be adequately identified and characterized, so that washing implements could be reliably made from mesh exhibiting all of the aforementioned desired physical properties.

SUMMARY OF THE INVENTION

It is an object of the present invention to provide a washing implement which overcomes the problems described above. It is a further object of the present invention to provide a washing implement which is soft, resilient and durable enough for bathing, scrubbing and the like. It is a related object of the present invention to provide a scrubbing or bathing implement which improves lather when used with soap.

It is yet another object of the present invention to provide a method of characterizing an open cell extruded mesh for use in manufacturing washing implements and the like with mesh having predetermined physical parameters and measurable performance tests so that the improved open cell mesh is easily manufactured and easily recreated as desired. It is an additional object of the present invention to provide methods of making soft, resilient and durable washing implements from open cell mesh with improved tactile and functional characteristics.

There is provided herein an improved washing implement made from an improved extruded open cell mesh featuring enhanced softness and resiliency through manipulation of structural characteristics. The improved washing implement is provided by shaping and binding the mesh into the desired implement configuration.

There is further provided herein a washing implement made from an improved extruded open cell mesh comprising a series of extruded filaments which are periodically bonded together to form repeating cells. The bonded areas between filaments are designated as "nodes", while a "cell" is defined by a plurality of filament segments with one node at each of its corners. The extruded cells of preferred embodiments are typically square, rectangular, or diamond shaped, at the time of extrusion, but the extruded mesh is often thereafter stretched to elongate the nodes, filaments, or both, to produce the desired cell geometry and strength characteristics of the resulting mesh. The mesh can be produced through a counter-rotating extrusion die, two reciprocating flat dies, or by other known mesh forming procedures. Tubes of mesh, such as can be produced by counter-rotating extrusion dies, have a preferred node count of between about 70 and about 140, with an especially preferred range of between about 90 and about 110. The nodes are measured circumferentially around the mesh tube. A preferred cell count of a tube or sheet of mesh is between about 130 and about 260 cells/meter, with an especially preferred range of between about 170 and about 250 cells/meter. Cell count is measured by a standardized test described herein.

In another preferred embodiment of the present invention, the extruded open cell mesh can be characterized as having a TAG Factor value of from about 520 meters/gram to about 1800 meters/gram. The TAG Factor value is a function of cell count, node count, basis weight, and the Initial Stretch, all of which are measurable quantities of open cell mesh made in accordance herewith. The Initial Stretch value can be obtained through the use of a standardized test method described herein. A preferred basis weight for mesh of the present invention to be utilized for washing implements is from about 5.60 grams/meter to about 10.50 grams/meter, and an especially preferred basis weight would be from about 6.00 grams/meter to about 8.85 grams/meter. Preferred Initial Stretch values are from about 7.0 inches to about 20.0 inches. More preferred Initial Stretch values are from about 9.0 inches to about 18.0 inches. Most preferred Initial Stretch values are from about 10.0 inches to about 16 inches.

In yet another preferred embodiment of the present invention, the extruded open cell mesh is extruded from low-density polyethylene with a Melt Index of between about 1.0 and about 10.0. The preferred low-density polyethylene has a Melt Index of between about 2.0 and about 7.0. Preferred nodes of the present invention have an approximate length, measured from opposing Y-crotches, of from about 0.020 inches (0.051 cm) to about 0.095 inches (0.241 cm), and have an effective diameter of from about 0.012 inches (0.030 cm) to about 0.028 (0.071 cm).

BRIEF DESCRIPTION OF THE DRAWINGS

While the specification concludes with claims particularly pointing out and distinctly claiming the present invention, it is believed the same will better be understood from the following description taken in conjunction with the accompanying drawings in which:

DETAILED DESCRIPTION OF THE PREFERRED EMBODIMENTS

Figure 1:
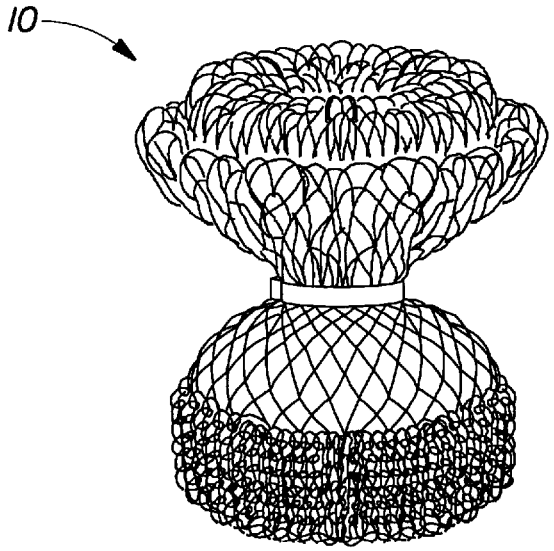
FIG. 1 illustrates an exemplary prior art hand-held hourglass shaped washing implement.
Figure 2:
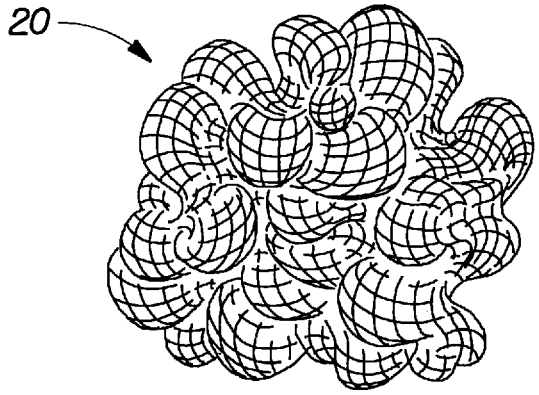
FIG. 2 illustrates an exemplary prior art hand-held ball shaped washing implement.

Reference will now be made in detail to the present preferred embodiments of the improved washing implement comprising an open cell mesh. Examples of washing implements which can be improved by utilization of the improved open cell mesh of the present invention are illustrated in the accompanying drawings where, FIG. 1 is an exemplary hand-held washing implement 10 manufactured in an hourglass shape, according to a method disclosed in U.S. Pat. No. 4,462,135, issued to Sanford, hereby incorporated by reference herein. FIG. 2 shows an alternative, ball-like configuration for a washing implement 20 made of mesh 18, and manufactured by a method disclosed in U.S. Pat. No. 5,144,744 issued to Campagnoli on Sep. 8, 1992, hereby incorporated by reference herein. These configurations for washing implements are exemplary only, and it is well known to those skilled in the art that there are other methods for producing washing implements of various configurations.

The embodiments discussed above are described in terms of a washing implement, and more particularly, a hand-held washing implement or "puff". The term hand-held is to be broadly construed to generally include open cell mesh manufactured into an implement that a person can hold in their hand during use. Likewise, the term washing implement is to be broadly construed to include various applications of such an implement for bathing, exfoliating skin, scrubbing pans, dishes and the like, as well as other uses.

The process of manufacturing diamond cell and hexagonal cell mesh for use in washing implements and the like involves the selection of an appropriate resin material which can include polyolefins, polyamides, polyesters, and other appropriate materials which produce a durable and functional mesh. Low density polyethylene (LDPE, a polyolefin), poly vinyl ethyl acetate, high density polyethylene or mixtures thereof are preferred to produce the mesh described herein, although other resin materials can be substituted provided that the resulting mesh conforms with the physical parameters defined below. Additionally, adjunct materials are commonly added to extruded mesh. Mixtures of pigments, dyes, brighteners, heavy waxes and the like are common additives to extruded mesh and are appropriate for addition to the mesh described herein.

To produce an improved open cell mesh, the selected resin is fed into an extruder by any appropriate means. Extruder and screw feed equipment for production of synthetic webs and open cell meshes are known and available in the industry.

After the resin is introduced into the extruder it is melted so that it flows through extrusion channels and into the counter-rotating die, as will be discussed in greater detail below. Resin melt temperatures will vary depending upon the resin selected. The material's Melt Index is a standard parameter for correlating extrusion die temperatures to the viscosity of the extruded plastic as it flows through the die. Melt Index is defined as the viscosity of a thermoplastic polymer at a specified temperature and pressure; it is a function of the molecular weight. Specifically, Melt Index is the number of grams of such a polymer that can be forced through a 0.0825 inch orifice in 10 minutes at 190 degrees C. by a pressure of 2160 grams.

A Melt Index of from about 1.0 to about 10.0 for LDPE is preferred for manufacturing the mesh described herein for use in washing implements, and a Melt Index of from about 2.0 to about 7.0 is especially preferred. However, if alternate resin materials are used and/or other ultimate uses for the mesh are desired, the Melt Index might be adjusted, as appropriate. The temperature range of operation of the extruder can vary significantly between the melt point of the resin and the temperature at which the resin degrades.

Figure 3:
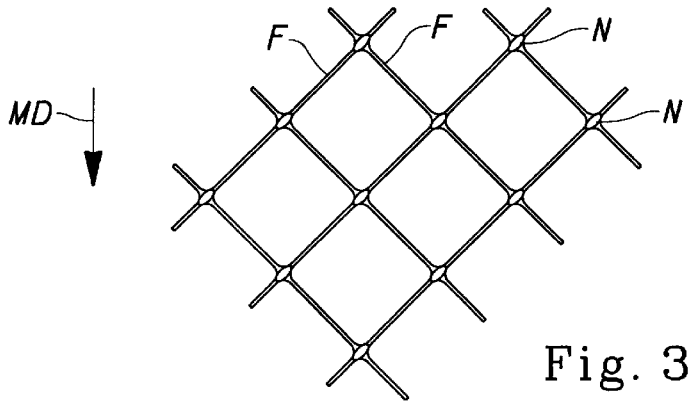
FIG. 3 illustrates an exemplary section of mesh after extrusion.

The liquefied resin can then be extruded through two counter-rotating dies which are common to the industry. U.S. Pat. No. 3,957,565 to Livingston, et. al., for example, describes a process for extruding a tubular plastic netting using counter-rotating dies, such disclosure hereby incorporated herein by reference. A counter-rotating die has an inner and outer die, and both have channels cut longitudinally around their outer and inner circumferences respectively, such that when resin flows through the channels, fibers are extruded. Individual fibers, e.g., F, as seen in FIG. 3, are extruded from each channel of the inner die as well as each channel of the outer die. As the two dies are rotated in opposite directions relative to one another, the channels from the outer die align with the channels of the inner die, at predetermined intervals. The liquefied resin is thereby mixed as two channels align and the two fibers, e.g., F, as seen in FIG. 3, being extruded are bonded until the extrusion channels of the outer and inner die are misaligned due to continued rotation. As the inner die and outer die rotate counter-directionally to each other, the process of successive alignment and misalignment of the channels of each die occurs repeatedly. The point at which the channels align and two fibers are bonded together is commonly referred to as a "node" (e.g. N of FIG. 3).

The "die diameter" is measured as the inner diameter of the outer die or the outer diameter of the inner die. These two diameters must be essentially equal to avoid stray resin from leaking between the two dies. The die diameter affects the final diameter of the tube of mesh being produced, although die diameter is only one parameter which controls the final diameter of the mesh tube. Although it is believed that a wide variety of die diameters, for example between about 2 inches and about 6 inches, are suitable for manufacturing the meshes described herein, especially preferred die diameters are in the range of between about 2½ and 3½ inches (about 6.35 and 8.89 centimeters).

The extrusion channels can likewise be varied among a variety of geometric configurations known to the art. Square, rectangular, D-shaped, quarter-moon, semi-circular, keyhole, and triangular channels are all shapes known to the art, and can be adapted to produce the mesh described herein. Quarter-moon channels are preferred for the mesh of the present invention, although other channels also provide acceptable results.

Figure 4:
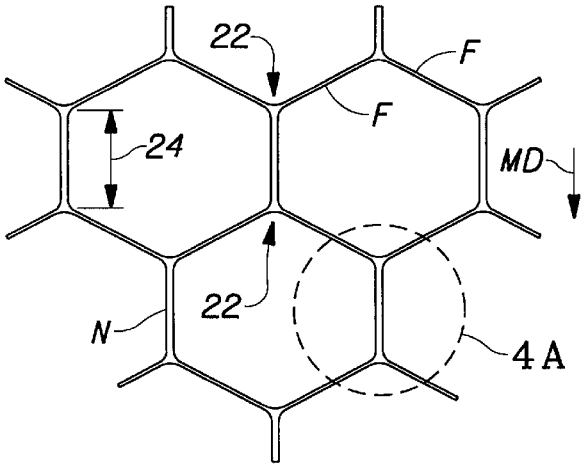
FIG. 4 illustrates an exemplary extruded mesh section after stretching.

After the tube of mesh is extruded from the counter-rotating dies, it can be characterized as having diamond-shaped cells, e.g., as shown in FIG. 3, where each of the four corners of the diamond is an individual node N and the four sides of the diamond are four, separately formed filament segments F. The tube is then pulled over a cylindrical mandrel where the longitudinal axis of the mandrel is essentially aligned with the longitudinal axis of the counter-rotating dies, i.e., the machine direction (MD as shown in FIGS. 3 and 4 ). The mandrel serves to stretch the web circumferentially resulting in stretching the nodes and expanding the cells. Typically the mandrel is immersed in a vat of water, oil or other quench solution, which is typically 25 degrees C. or less, which serves to cool and solidify the extruded mesh.

The mandrel can be a variety of diameters, although it will be chosen to correspond appropriately to the extrusion die diameter. The mandrel is preferably larger in diameter than the die diameter to achieve a desired stretching effect, but the mandrel must also be small enough in diameter to avoid damaging the integrity of the mesh through overstretching. Mandrels used in conjunction with the preferred 2.5"–3.5" die diameters mentioned above might be between about 3.0" and 6.0" (about 7.62 and 15.24 cm). Mandrel diameter has been found to have a pronounced effect on the resiliency and softness of the mesh produced, which is characterized by the Initial Stretch value described in greater detail below.

Figure 4A:
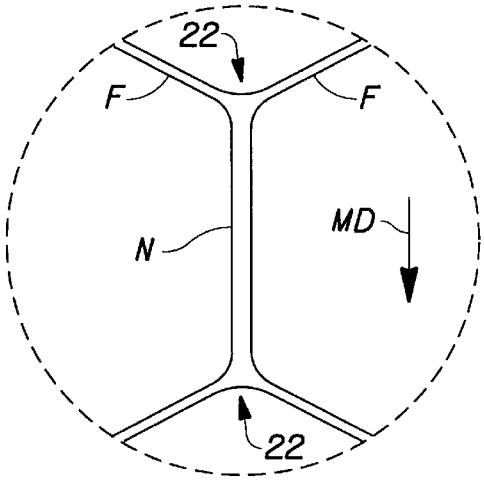
FIG. 4A illustrates an enlarged exemplary view of a node after stretching.

As the nodes of the diamond cell mesh are stretched, they are transformed from small, ball-like objects, e.g., N of FIG. 3, to longer, thinner filament-like nodes, e.g. N of FIG. 4 and 4A. The cells are thereby also transformed from a diamond-like shape to hexagonal-shape wherein the nodes form two sides of the hexagon, and the four individual filament segments F form the other four sides of the hexagon. The geometric configuration of the mesh cells can also vary significantly depending on how the tube of mesh is viewed. Thus, the geometric cell descriptions are not meant to be limiting but are included for illustrative purposes only.

After passing over the mandrel, the tube is then stretched longitudinally over a rotating cylinder whose longitudinal axis is essentially perpendicular to the longitudinal axis of the tube, i.e. the longitudinal axis of the rotating cylinder is perpendicular to the machine direction, MD of the mesh. The mesh tube is then pulled through a series of additional rotating cylinders whose longitudinal axis is perpendicular to the longitudinal axis, or the machine direction, (MD), of the extruded mesh.

Preferably the mesh is taken-up faster than it is produced, which supplies the desired longitudinal, or machine direction MD, stretching force. Typically a take-up spool is used to accumulate the finished mesh product. As should be apparent, there are a variety of process parameters (e.g., resin feed rate, die diameter, channel design, die rotation speed and the like) that affect mesh parameters such as node count, basis weight and cell count.

Although the production of open cell mesh in a tube configuration through the use of counter-rotating dies as described is preferred for the embodiments of the present invention, alternative processing means are known to the art. For example, U.S. Pat. No. 4,123,491 to Larsen (the disclosure of which is hereby incorporated herein by reference), shows the production of a sheet of open cell mesh wherein the filaments produced are essentially perpendicular to one another, forming essentially rectangular cells. The resulting mesh net is preferably stretched in two directions after production, as was the case with the production of tubular mesh described above.

Yet another alternative for manufacturing extruded open cell mesh is described in U.S. Pat. No. 3,917,889 to Gaffney, et al., the disclosure of which is hereby incorporated herein by reference. The Gaffney, et al. reference describes the production of a tubular extruded mesh, wherein the filaments extruded in the machine direction are essentially perpendicular to filaments or bands of plastic material which are periodically formed transverse to the machine direction. The material extruded transverse to the machine direction can be controlled such that thin filaments or thick bands of material are formed. As was the case with the mesh manufacturing procedures described above, the tubular mesh manufactured according to the Gaffney, et al. reference is preferably stretched both circumferentially and longitudinally after extrusion.

Figure 8:
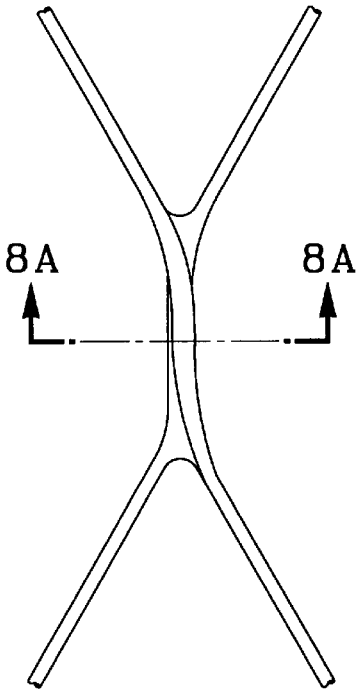
FIG. 8 illustrates an overlaid node in open cell mesh.
Figure 8A:
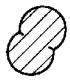
FIG. 8A illustrates a cross sectional view of the node of FIG. 8.

A key parameter when selecting a manufacturing process for the improved mesh described herein is the type of node produced. As was described above, a node is the bonded intersection between filaments. Typical prior art mesh is made with overlaid nodes (FIGS. 8 and 8A). An overlaid node can be characterized in that the filaments which join together to form the node are still distinguishable, although bonded together at the point of interface. In an overlaid node, the filaments at both ends of the node form a Y-crotch, although the filaments are still relatively distinguishable at the interface of the node. Overlaid nodes result in mesh which has a scratchy feel.

Figure 7:
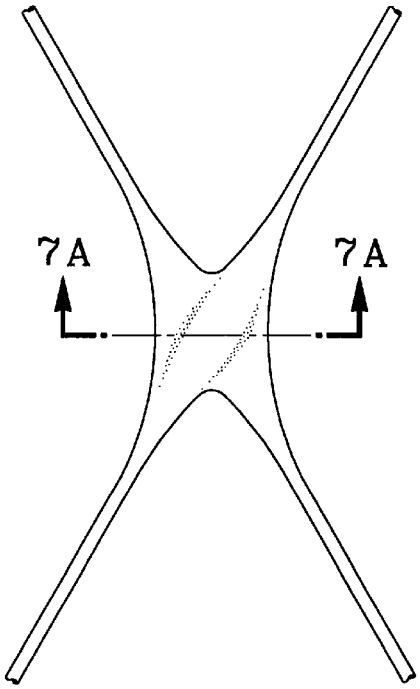
FIG. 7 illustrates a merged node in open cell mesh.
Figure 7A:
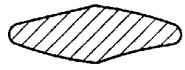
FIG. 7A illustrates a cross sectional view of the node of FIG. 7.

A merged node (FIGS. 7 and 7A) can be characterized by the inability after production of the mesh to easily visually distinguish the filaments which formed the node. Typically, a merged node resembles a wide filament segment. A merged node can have a "ball-like" appearance, similar to that shown by N of FIG. 3, or can be stretched subsequent to formation to have the appearance of node N of FIGS. 4 and 4A. In either case, at each end of the node there is a Y-crotch configuration, e.g., 2 of FIGS. 4 and 4A, at the point where the filament segments F branch off the node. For both overlaid and merged nodes, node length 24 of FIG. 4 is defined as the distance from the center of the crotch of one Y-shape to the center of the crotch of the Y-shape at the opposite end of the node. The combination of merged nodes with specific TAG Factor Values (described below) results in a mesh with a consumer preferred range of softness and resiliency, specifically when used in cleansing implements.

Node diameter is not easily measured because nodes rarely have uniform crosssectional diameters. However, an "effective diameter" can be defined as the average between a node's smallest diameter and its largest diameter measured near the midpoint between the Y-crotches at each end. As should be apparent, the measurement of node length and node diameter are to be compared at the conclusion of the extrusion process, (i.e., after the material has been through the stretching steps). Preferred nodes of mesh to be used for washing implements have an approximate length, measured from opposing crotches, of from about 0.020 inches (0.051 cm) to about 0.095 inches (0.241 cm), and the nodes have an effective diameter of from about 0.012 inches (0.030 cm) to about 0.028 inches (0.071 cm). The nodes can also be characterized as having a thickness of from about 0.008 inches (0.020 cm) to about 0.015 inches (0.038 cm), and a width of from about 0.015 inches (0.038 cm) to about 0.040 inches (0.102 cm).

Figure 5:
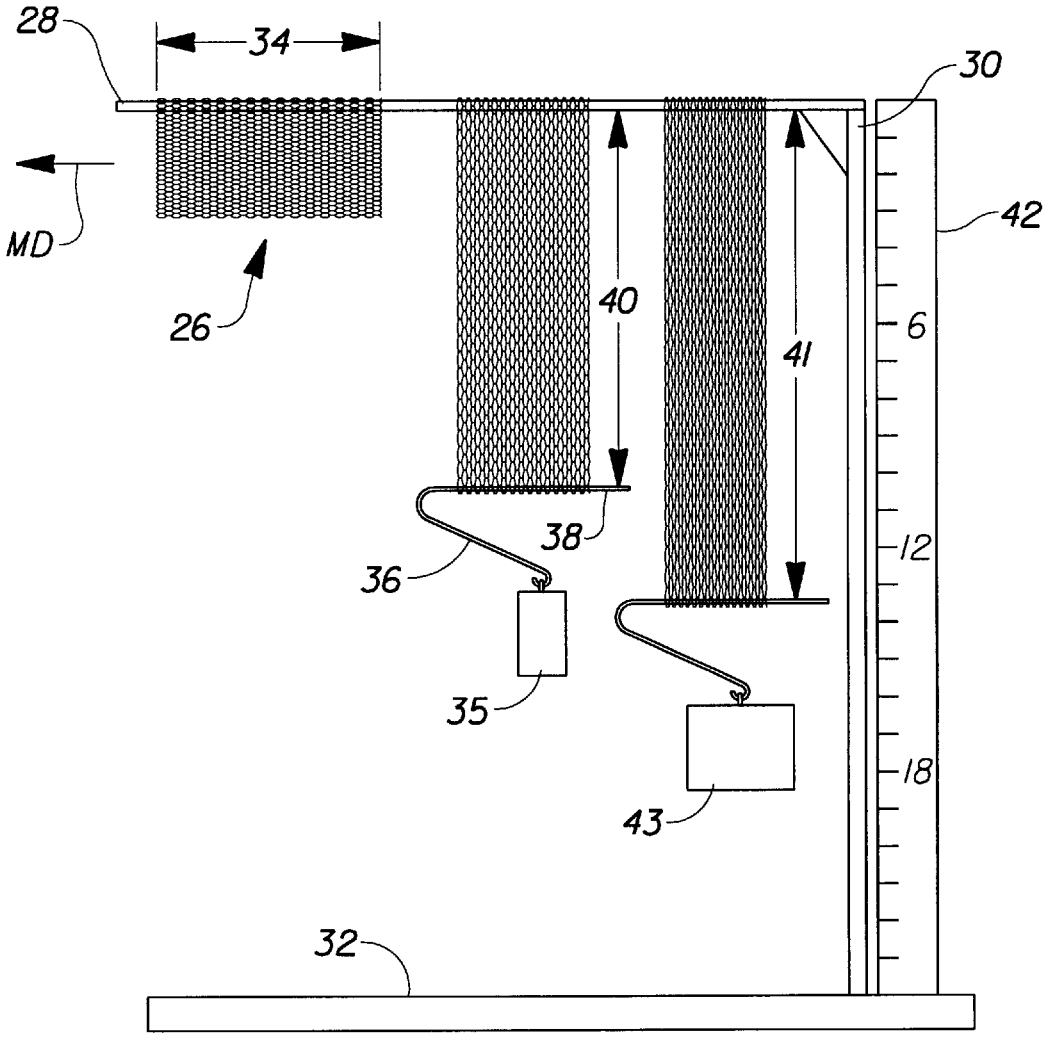
FIG. 5 is a schematic illustration of testing procedures for measuring: an open cell mesh's resistance to an applied weight; useful in characterizing the open cell mesh made according to the subject invention.

As will be apparent, the measurement of flexibility of a mesh is a critical characterization of the softness and conformability of a mesh. It has been determined that a standardized test of mesh flexibility can be performed as described herein and as depicted in FIG. 5. The resulting measurement of flexibility is defined herein as Initial Stretch. As schematically illustrated in FIG. 5, the procedure for determining Initial Stretch begins by hanging a mesh tube 26 from a test stand horizontal arm 28, which in turn is supported by a vertical support member 30 and which is in turn attached to a test stand base 32. The tube of mesh is hung from arm 28 so that its machine direction (MD) is parallel to arm 28.

As was described above, when the open cell mesh is extruded from a counter-rotating die, the mesh is formed in a tube. If a sheet of mesh is produced, as was described in the Larsen '491 patent, the sheet must be formed into a tube by binding the sheet's edges securely together prior to performing the Initial Stretch measurement. The tube of mesh 26 for testing should be 6.0 inches (15.24 centimeters) in length, as indicated by length 34. Six inches was chosen, along with a 50.0 gram weight, as an arbitrary standard for making the measurement. As will be apparent, other standard conditions could have been chosen; however, in order to compare Initial Stretch values for different meshes, it is preferred that the standard conditions chosen and described herein are followed uniformly.

As is illustrated in FIG. 5, a standardized weight is suspended from a weight support member 36, which has a weight support horizontal arm 38 placed through and hung from the mesh tube 26. It is critical that the total combined weight of the weight support member 36 and the standardized weight equal 50 grams. Distance 40 illustrates the Initial Stretch, and is the distance which mesh tube 26 stretches immediately after the weight has been suspended from mesh tube 26. A linear scale 42 is preferably used to measure distance 40. For mesh of the present invention it is generally preferred to have a Initial Stretch value of from about 7.0 inches (17.8 cm) to about 20.0 inches (50.8 cm), more preferred to have an Initial Stretch value of from about 9.0 inches (22.9 cm) to about 18.0 inches (45.7 cm), and most preferred to have an Initial Stretch value of from about 10.0 inches (25.4 cm) to about 16.0 inches (40.6 cm).

The resilient property of the open cell mesh can be measured by suspending a larger standardized weight (i.e., 250 grams, shown in FIG. 5) from the mesh sample 26, and substracting the distance 40 from the distance 41. It is critical that the total combined weight of the weight support member and the larger standardized weight equal 250 grams. This value is directly proportional to the level of resilience in the material.

Figure 6:
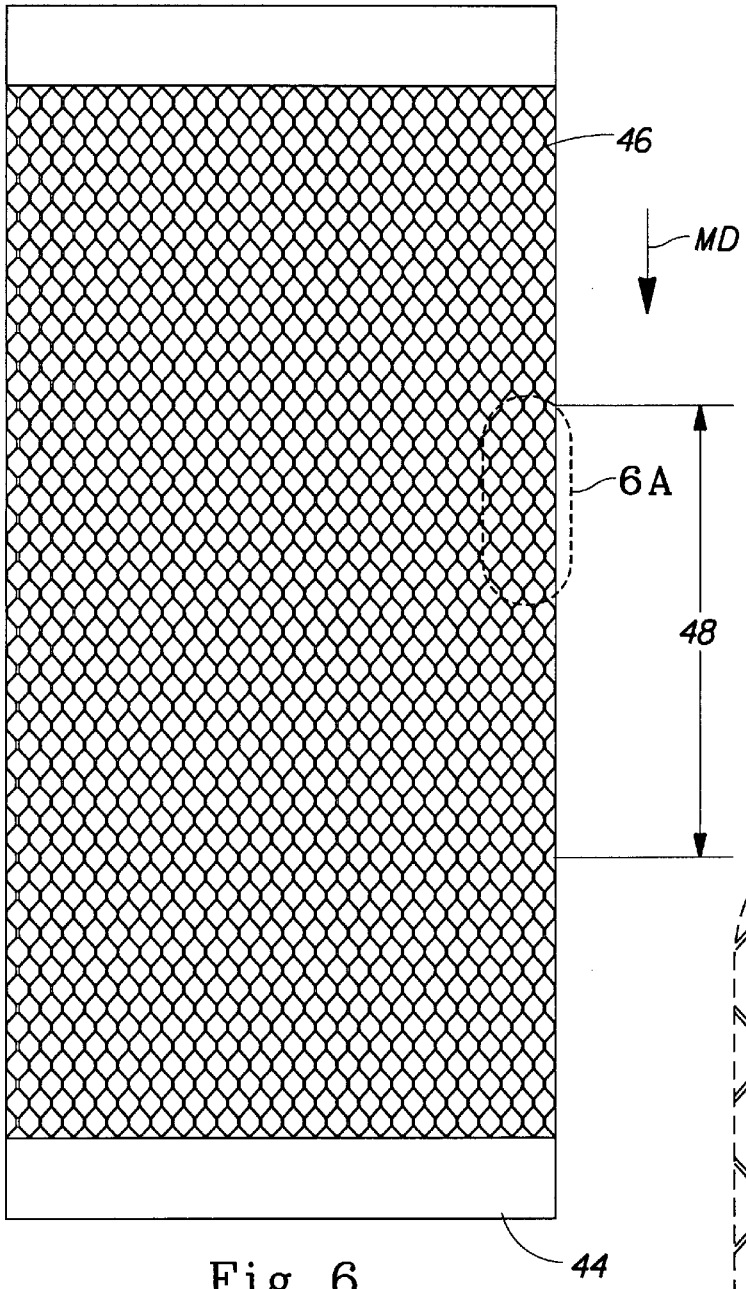
FIG. 6 illustrates a section of mesh used for counting cells in an open cell mesh.
Figure 6A:
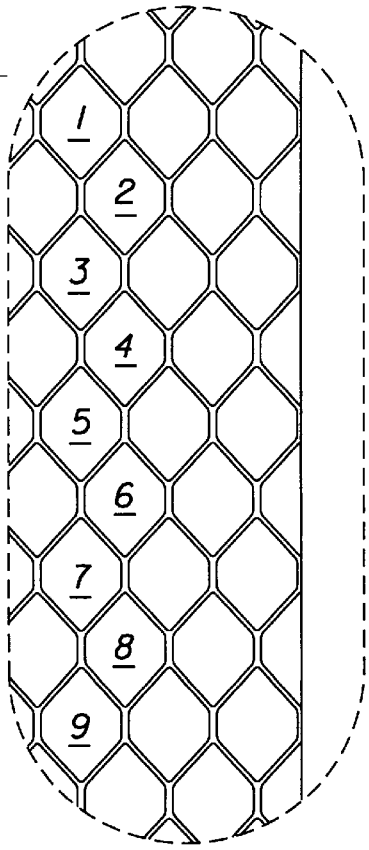
FIG. 6A is an exploded view of the mesh section of FIG. 6.

FIG. 6 illustrates a standardized method for counting cells; a staggered row of cells are counted out in the machine direction of the tube of mesh, as shown in FIG. 6A. The mesh 46 is a length of tubular mesh greater than twelve inches in length. The mesh section 46 is pulled taught along its machine direction (MD). When the mesh is taught, a twelve inch segment 48 is marked off, for example with a felt tipped marker.

After the mesh section 48 is marked off, the mesh may be pulled in a direction transverse to the longitudinal axis; the idea here is to open up the cells enough so that they may be comfortably counted. A rigid frame 44 may be used to secure mesh 46 so that the segment of mesh 48 being counted is held firmly in place. FIG. 6A illustrates an enlarged portion of the mesh, with numbers 1 through 9 indicating individually counted cells. As can be seen in FIG. 6A, one cell in each row is counted down the length of the marked off portion of the tube, every other cell is vertically aligned due to the diamond or hexagonal cell configuration. This yields the cells per unit length (in FIG. 6, the value would be about 28.5 cells per foot). For the purpose of standardization, a 12.0 inch section of mesh (30.48 cm) is counted to arrive at the number of cells per foot. As will be apparent, counting a shorter or longer segment of mesh is acceptable, provided that the cell count is divided by the length of the marked off section, and ultimately converted to cells/meter for reasons which will be discussed in more detail hereinafter.

Characterizing the improved mesh in the direction transverse to the machine direction is accomplished by counting a string of nodes along a line around the circumference of the tube of mesh. This method is universal to tubes or flat sheets of mesh and simply comprises selecting a linear row of nodes and counting them. As should be apparent, any row of nodes will contain an identical number of nodes; this is dependent on the extrusion die configuration. Preferred ranges for node count for mesh to be used for washing implements are between about 70 and about 140. Especially preferred ranges are between about 90 and about 110.

Basis weight is another empirical measurement which can be performed on any tube or sheet of extruded open cell mesh. A length of mesh is measured along the machine direction, then cut in a direction across the machine direction, with this measured and cut section then being weighed. The basis weight is preferably tracked in units of grams per meter. For purposes of standardization, a 12.0 inch section of mesh (30.48 cm) is measured, cut and weighed, and the results reported in grams per meter. The preferred basis weight for mesh of the subject invention to be used for washing implements is from about 5.60 grams/meter to about 10.50 grams/meter, with an especially preferred range of from about 6.00 grams/meter to about 8.85 grams/meter.

The preferred meshes of the present invention can be characterized by a compilation of the aforementioned measurable parameters. As should be apparent, the processing parameters described above can be varied individually or in combination to produce the desired physical properties described herein. The most useful value for characterizing the subject meshes is the "TAG Factor" value. The variables must all be converted to metric units before calculating the "Tag Factor", i.e., Initial Stretch must be expressed in meters, Basis Weight must be expressed in grams per meter, Cell Count must be expressed as cells per meter, and Node Count would have no units. "TAG Factor" is defined by a fraction having the Initial Stretch multiplied by the Relative Cell Size as its numerator, and Basis Weight as its denominator. The TAG factor is used since the flexibility of a netting material has been found to be directly proportional to the relative cell size, and inversely proportional to basis weight. The TAG factor accounts (Normalizes) for these relationships thus allowing a variety of netting basis weight and cell size combinations to be compared for their relative flexibility.

The TAG factor is computed using the following equation:

$$\text{TAG Factor} = \frac{\text{Initial Stretch/Relative Cell Size}}{\text{Basis Weight}}$$

Relative cell size is defined as:

$$\text{Relative Cell Size} = \frac{1}{(\text{Cell Count*Node Count})} = \frac{1}{\text{Total Cells}}$$

In this calculation Cell Count multiplied by Node Count is equivalent to the Total Number of cells in a fixed length sample of netting tube, for a given circumference tube. Relative Cell Size is inversely proportional to the total number of cells in a given sample of netting material. This relationship is true since the more cells per fixed sample size, the smaller the size of each individual cell.

The units of the TAG Factor are meters/gram. It has been found that meshes having a TAG Factor value of from about 520 meters/gram to about 1800 meters/gram have superior softness characteristics while retaining sufficient resiliency for improved functionality as in washing implements. An especially preferred TAG Factor value is from about 580 meters/gram to about 1700 meters/gram, and an even more preferred range is from about 700 meters/gram to about 1500 meters/gram.

Through the course of experimentation we have discovered that netting materials that are highly flexible under a very low level of stress are perceived by consumers as having a much softer feel on the skin. Further, when this highly flexible netting is formed into a bathing implement, the resulting implement significantly improves consumer ratings for both the cleansing implement as well as the cleaning product it is used with.

We hypothesize that the improved consumer ratings are directly attributable to the more flexible netting materials ability to conform easily to body contours, and to more evenly distribute applied forces thus reducing abrasion. The result is an improved consumer perception of "softness", and not being "scratchy".

Low stress flexibility is quantified by taking a 6 inch sample of netting & measuring the distance it is deformed/stretched under a fixed 50 gram load. This is referred to as a materials Initial Stretch. We have found that for a fixed set of netting parameters (e.g. basis weight & cell size) the greater the magnitude of Initial Stretch the higher the consumer perception of softness.

We have also found that a netting materials Initial Stretch measure is inversely related to its' basis weight, and directly related to the size of its' cells. As a result we've found it helpful to "normalize" the Initial Stretch value to account for the corresponding relationships with basis weight & cell size. This normalized value is referred to as the TAG Factor. The TAG Factor enables the flexibility of a variety of materials (having differing basis weights & cell sizes) to be compared for their relative flexibility level.

We have found that all currently available netting materials have TAG factors below about 520. Also, we've found that all these materials are relatively firm (not soft), and are generally abrasive on skin ("scratchy"). Materials having a TAG Factor above 520 are directionally more flexible, & are consistently perceived by consumers as being softer.

The benefits of the improved mesh of this invention when used as a washing implement or the like, include improved consumer acceptability, improved softness when the washing implement is rubbed against human skin. Improved lathering is also an important quality of bathing implements made from mesh of the present invention. Lather is improved when the soap is in bar, liquid, and most importantly gel form. When mesh is used in the production of washing implements, tactile softness, i.e., the feel of the mesh as it contacts human skin is an important criteria. However, resiliency is also an important physical criteria. It may be intuitive that producing a softer mesh would result in a relatively limp mesh which may not retain the desired shape for the washing implement, i.e., stiffniess sacrificed in favor of softness. However, mesh of the present invention which has a TAG Factor value greater than about 520 meters/gram has been found to have the unique properties of being both soft and relatively resilient, i.e. the mesh is able to retain its shape when used as a washing implement. A washing implement which is soft but does not conform to the skin or object being scrubbed (i.e., the implement is limp), or is not resilient, is generally not acceptable to consumers. Therefore, the improved open cell mesh described herein provides a material which is both soft to the touch and, when used to manufacture washing implements, is resilient enough to provide the necessary conformability which is preferred by consumers.

Having showed and described the preferred embodiments of the present invention, further adaptation of the improved open cell mesh and resulting washing implement can be accomplished by appropriate modifications by one of ordinary skill in the art without departing from the scope of the present invention. A number of alternatives and modifications have been described herein and others will be apparent to those skilled in the art. For example, specific methods of manufacturing washing implements from open cell mesh have been described although other manufacturing processes can be used to produce the desired implement. Likewise, broad ranges for the physically measurable parameters have been disclosed for the inventive open cell mesh as preferred embodiments of the present invention, yet within certain limits, the physical parameters of the open cell mesh can be varied to produce other preferred embodiments of improved mesh of the present invention as desired. Accordingly, the scope of the present invention should be considered in terms of the following claims and is understood not be limited to the details of the structures and methods shown and described in the specification and in the drawings.

We claim:

1. A washing implement comprising:

an extruded open cell mesh, the mesh comprising;

a series of cells defined by a plurality of filament sections, a plurality of nodes wherein the nodes comprise intersections of the filament sections, and a node count of from about 70 to about 125;

wherein the open cell mesh has a TAG Factor value of from about 520 meters/gram to about 1800 meters/gram; and the open cell mesh is shaped and bound into a hand held implement suitable for use as a washing implement.

2. A washing implement according to claim 1, wherein the open cell mesh has a TAG Factor value of from about 580 meters/gram to about 1700 meters/gram, and the node count is from about 90 to about 110.

3. A washing implement according to claim 1, wherein the open cell mesh has a TAG Factor value of from about 700 meters/gram to about 1500 meters/gram, and the node count is from about 90 to about 110.

4. A washing implement according to claim 1, wherein the mesh comprises low density polyethylene, poly vinyl ethyl acetate, high density polyethylene, ethylene vinyl acetate, or mixtures thereof.

5. A washing implement according to claim 1, wherein the mesh comprises low density polyethylene with a Melt Index of between about 1.0 gms/10 mins. and about 10.0 gms/10 mins.

6. A washing implement according to claim 5, wherein the low density polyethylene has a Melt Index of between about 2.0 gms/10 mins. and about 7.0 gms/10 mins.

7. A washing implement according to claim 1, wherein the nodes each have opposing Y-crotch ends, the nodes each having an approximate length, as measured between the Y-crotch ends, of from about 0.051 centimeters to about 0.241 centimeters, and each node has an effective diameter of from about 0.030 centimeters to about 0.071 centimeters.

8. A washing implement comprising:

an extruded open cell mesh, the mesh comprising;

a series of cells defined by a plurality of filament sections, a plurality of nodes wherein the nodes comprise merged intersections of the filament sections, and a node count of from about 70 to about 125;

wherein the open cell mesh has a TAG Factor value of from about 520 meters/gram to about 1800 meters/gram; and the open cell mesh is shaped and bound into a hand held implement suitable for use as a washing implement.

9. A washing implement according to claim 8, wherein the open cell mesh has a TAG Factor value of from about 580 meters/gram to about 1700 meters/gram, and the node count is from about 90 to about 110.

10. A washing implement according to claim 8, wherein the open cell mesh has a TAG Factor value of from about 700 meters/gram to about 1500 meters/gram, and the node count is from about 90 to about 110.

11. A washing implement according to claim 8, wherein the mesh comprises low density polyethylene, poly vinyl ethyl acetate, high density polyethylene, ethylene vinyl acetate, or mixtures thereof.

12. A washing implement according to claim 8, wherein the mesh comprises low density polyethylene with a Melt Index of between about 1.0 gms/10 mins. and about 10.0 gms/10 mins.

13. A washing implement according to claim 12, wherein the low density polyethylene has a Melt Index of between about 2.0 gms/10 mins. and about 7.0 gms/10 mins.

14. A washing implement according to claim 8, wherein the nodes each have opposing Y-crotch ends, the nodes each having an approximate length, as measured between the Y-crotch ends, of from about 0.051 centimeters to about 0.241 centimeters, and each node has an effective diameter of from about 0.030 centimeters to about 0.071 centimeters.

15. A washing implement comprising:

an improved extruded open cell mesh, the mesh comprising;

a series of cells defined by a plurality of filament sections, a plurality of nodes wherein the nodes comprise merged intersections of the filament sections, and a node count of from about 70 to about 125;

each node having a Y-crotch configuration at each end, wherein the Y-crotch is formed at the intersection of at least two filament sections;

wherein the open cell mesh has a TAG Factor value of from about 520 meters/gram to about 1800 meters/gram; and the open cell mesh is shaped and bound into a hand held implement suitable for use as a washing implement.

16. A washing implement according to claim 15, the open cell mesh being extruded low density polyethylene, poly vinyl ethyl acetate, high density polyethylene, ethylene vinyl acetate or mixtures thereof.

17. A washing implement according to claim 15, wherein the open cell mesh has a TAG Factor value of from about 580 meters/gram to about 1700 meters/gram, and the node count is from about 90 to about 110.

18. A washing implement according to claim 15, wherein the open cell mesh has a TAG Factor value of from about 700 meters/gram to about 1500 meters/gram, and the node count is from about 90 to about 110.

19. A washing implement according to claim 15, wherein the mesh comprises low density polyethylene with a Melt Index of between about 1.0 gms/10 mins. and about 10.0 gms/10 mins.

20. A washing implement according to claim 19, wherein the low density polyethylene has a Melt Index of between about 2.0 gms/10 mins. and about 7.0 gms/10 mins.

* * * * *